United States Patent [19]

Berinson

[11] Patent Number: 4,530,482

[45] Date of Patent: Jul. 23, 1985

[54] PICTURE MOUNT AND SYSTEM FOR HANGING PICTURES

[76] Inventor: Robert Berinson, 203 Leighton Ave., Silver Spring, Md. 20901

[21] Appl. No.: 262,518

[22] Filed: May 11, 1981

[51] Int. Cl.[3] ..... A47F 7/14

[52] U.S. Cl. ..... 248/475.1; 248/225.1

[58] Field of Search ..... 248/475 R, 494, 495, 248/467, 225.1, 225.2

[56] References Cited

U.S. PATENT DOCUMENTS

| | | | |
|---|---|---|---|
| 365,676 | 6/1887 | Egan | 248/495 |
| 3,098,272 | 7/1963 | Frye | 248/467 X |
| 3,254,438 | 6/1966 | Filary et al. | 248/467 X |
| 3,345,709 | 10/1967 | Bearman | 248/205.3 |
| 3,597,586 | 8/1971 | Rebovich | 248/475 R X |
| 3,856,249 | 12/1974 | Frye | 248/205.3 |
| 4,165,852 | 8/1979 | Chervenak | 248/225.2 |

FOREIGN PATENT DOCUMENTS

| | | | |
|---|---|---|---|
| 470274 | 8/1937 | United Kingdom . | |
| 1031208 | 6/1966 | United Kingdom | 248/475 R |

*Primary Examiner*—J. Franklin Foss

[57] ABSTRACT

A novel picture mounting means including elongated thin strip that conforms to the irregularities of a wall for permanent installation on a wall at eye level which can be included in a system, when mounted wall to wall, permitting the hanging of horizontally aligned pictures which carry on their backs an elongated interfitting frictional means so as to avoid injury to such wall surface by shifting or replacing of a picture.

1 Claim, 6 Drawing Figures

PICTURE MOUNT AND SYSTEM FOR HANGING PICTURES

This invention relates to a new and novel means for mounting pictures on a wall in fixed horizontal alignment.

Conventional picture hanging means include a two part construction wherein a nail, or screw or bracket is attached to a wall and a picture is either wired or has a bracket attached thereto by which the picture is hung. Use of a single nail or screw on the wall can unbalance the hung picture while most bracket combinations are hard to align and interleave because surfaces of a wall and of a picture are not perfectly straight resulting in disfigurement of the wall.

It is the object of this invention to avoid all these difficulties by providing a relatively inexpensive wall mount that can be horizontally aligned upon a wall and when attached can remain as a permanent part of the wall.

Another object is to take advantage of the pliability of plastic by making a wall mount which will follow and conform to the irregularities of a wall upon which it is mounted and which can be transparent so as to blend with the wall or colored to conform with the wall decor.

Since one of the main objects of this invention is to eliminate recurrent injury to walls by picture hanging, a system of horizontal alignment has been provided wherein a relatively thin elongated mounting strip is attached wall to wall at eye level which is intended to become a permanent structure on the wall so that it can be similarly decorated as the rest of the wall.

A further object is to obtain perfect horizontal alignment of all pictures hung on a single wall.

A further object is to include one or more electrical sockets along the wall to wall mounting strip, if illumination should be required for an oil painting.

A further object is to provide a permanent mounting strip on the wall which can be used for mounting pictures at eye level along any position from wall to wall.

A further object is to provide a retail picture store, or a museum with a permanent wall mounting means stretching from wall to wall to display or store pictures by providing rows of mounting strips wall to wall interplaced from ceiling to floor.

A further object is to provide such wall to wall strip hanging means in office buildings, classrooms, lecture halls, and similar places to enable the displayer to change from one picture to another with minimal effort.

Another object is to use a construction of material befitting the weight of the pictures to be hung.

Other and further objects and advantages of this invention will become apparent to those skilled in the art from a consideration of the following specification when read in conjunction with the annexed drawing.

Figure 1:
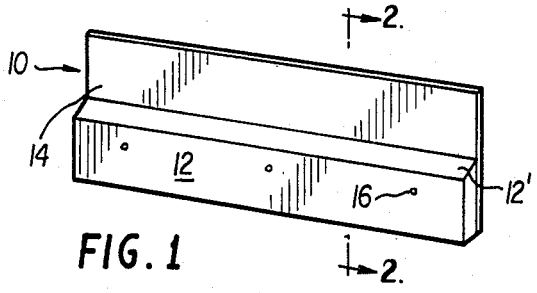
FIG. 1 is an elevational plan view of the elongated mounting strip of this invention.
Figure 2:
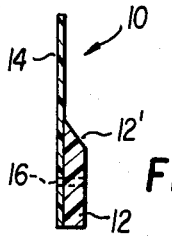
FIG. 2 shows a cross-sectional view of the mounting strip on line 2—2 showing its construction of FIG. 1.

Referring to the drawings in greater detail, picture mounting thin elongated strip 10 preferably made of a suitable resin plastic such as vinyl, acrylate, or phenolic which may be transparent or colored containing 3 mounting openings 12 for horizontal attachment on a wall. As shown in FIG. 2 the cross-section of the lower half 14 is 1.3 mm in height, 4 mm thick and the upper part 16 is razor sharp extending 2.5 mm from its bottom and the corner at the top of bottom part is kerfed inwardly provides as shown at 12' to more easily receive the picture mounting means.

Figure 3:
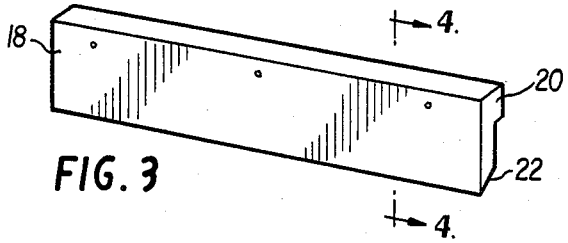
FIG. 3 shows an elevational plan view of picture mounting strip.
Figure 4:
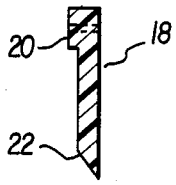
FIG. 4 shows a cross-sectional view on 4—4 of the picture mounting strip of FIG. 3.
Figure 5:
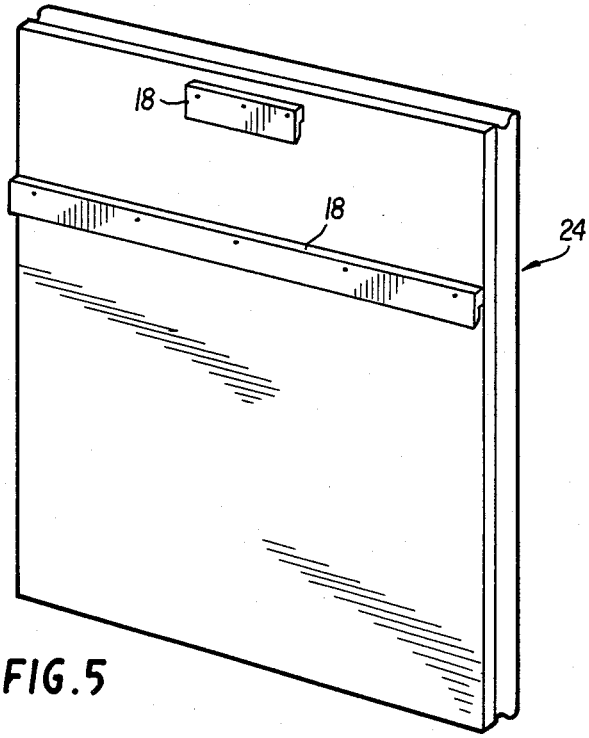
FIG. 5 shows a top back plan view of a picture to be mounted by an elongated mounted strip which is shorter or as long as the width of the picture.

As illustrated in FIG. 3, there is shown an elongated cooperating mounting strip 18 which is similar in composition to the wall mounting strip that is so constructed as to form an interfitting rough knife edge 22 which will slide between the razor edge 14 of the wall mounted strip. A choice of length of the picture mounting strip could be short as shown at 18 or long from edge to edge of the picture as shown at 24.

It is important to note that this specific picture mounted means could be replaced by a wire. If a wire is used instead it will hang horizontally on the elongated wall mount means because said wire will seat itself along the full length of the wall strip and it then cannot be easily shifted out of horizontal position.

The picture mount could also be replaced with a metal saw toothed hanger that is currently used as a hanging mechanism for pictures. This saw toothed means would fit over and slip into the pocket of the elongated wall strip to hold the picture in a firm horizontal position on the wall.

Although the elongated mounting strip is preferably made from plastic, it could be replaced with wood or metal as required by the weight of the object to be hung. Though pictures have been stressed, it is also contemplated that this same mounting strip could be used to suspend bric-a-brack by using suitable attachment means.

Figure 6:
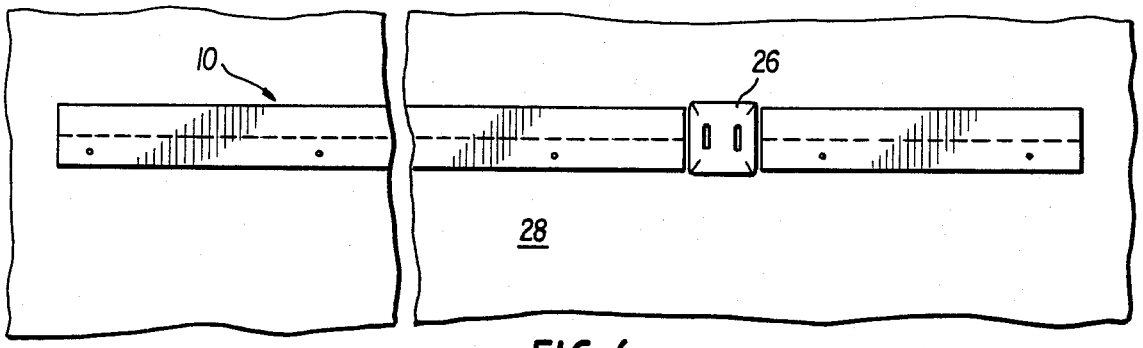
FIG. 6 shows a plan view of an elongated mounting strip which is wall to wall showing an interspersed electrical outlet.

Since the main object of this invention is to eliminate recurrent wall damage that results when pictures are repositioned or replaced on a wall surface, it is proposed to provide a wall hanging system such as illustrated in FIG. 6 wherein an elongated mounting strip 22 is mounted wall to wall 28 at eye level and is preferably made pf pliable plastic that can be transparent or colored which can be nailed or glued to the wall and wherein an electrical socket 26 is provided to illuminate an oil painting.

It is intended that this strip when mounted becomes a permanent fixture of the wall. When a tenant of a house or an apartment or a office moves, he simply removes his pictures and his replacement then hangs up his own pictures, thus the wall is not injured and ready for all comers.

There is no system in the prior art to hang pictures, then replace them, without injury to a wall as this system accomplishes. A wide utility of this system is possible in museums, office buildings, classrooms, lecture halls, retail picture stores, wholesale picture stores, residences in apartments and houses, where ever pictures, maps or illustrations are to be displayed. In storage or art stores, where recurrent injury to wall and picture is of great concern, the elongated hanging strip of this invention can be permanently installed from wall to wall in properly spaced position from ceiling to floor so as to yield a permanent hanging means that will eliminate injury to either the wall or the picture. An added benefit is that this hanging means system for the first time enables a picture to hang closely to the wall in almost parallel relation to said wall.

Although as illustrated this picture mounting means has been preferably shown to be razor edge for easy frictional interfitting with the wall mounting strip disclosed herein. However interfitting picture mounting means can be equally employed, so long as such picture mounting means enables easy removal, shifting or replacement on the wall mounting strip.

What is claimed is:

1. A wall system for firmly hanging pictures on a wall wherein the wall mount is a long elongated transparent resinous strip whose length extends the full width of a wall in a room to become a permanent part of said wall, said strip having a lower thickened portion and an upper thinned portion so that when mounted contacts said wall and wherein the picture mount having a knife edge interfits between said wall and said wall mount to frictionally fasten the picture to said wall, and wherein the thickness of said knife edge is about 0.05 millimeters and the base about 4 millimeters thick, and wherein an electric socket is emplaced at a suitable spaced point along the wall mounted strip.

* * * * *